US008481831B2

(12) United States Patent
Tanabe

(10) Patent No.: US 8,481,831 B2
(45) Date of Patent: Jul. 9, 2013

(54) STRINGED INSTRUMENT

(76) Inventor: Mamoru Tanabe, Tokyo (JP)

( * ) Notice: Subject to any disclaimer, the term of this patent is extended or adjusted under 35 U.S.C. 154(b) by 10 days.

(21) Appl. No.: 13/378,599

(22) PCT Filed: Jun. 16, 2010

(86) PCT No.: PCT/JP2010/004020
§ 371 (c)(1),
(2), (4) Date: Jan. 31, 2012

(87) PCT Pub. No.: WO2010/146858
PCT Pub. Date: Dec. 23, 2010

(65) Prior Publication Data

US 2012/0118125 A1 May 17, 2012

(30) Foreign Application Priority Data

Jun. 17, 2009 (JP) ..... 2009-144332

(51) Int. Cl.
*G10D 3/06* (2006.01)

(52) U.S. Cl.
USPC ..... 84/314 N; 84/293

(58) Field of Classification Search
USPC ..... 84/314 N, 293
See application file for complete search history.

(56) References Cited

U.S. PATENT DOCUMENTS

| | | | | | |
|---|---|---|---|---|---|
| 1,714,502 | A * | 5/1929 | Franic | ..... | 84/269 |
| 1,732,468 | A * | 10/1929 | Hagberg | ..... | 84/293 |
| 3,392,618 | A * | 7/1968 | Pelensky | ..... | 84/267 |
| 4,078,468 | A * | 3/1978 | Civitello | ..... | 84/274 |
| 5,097,737 | A * | 3/1992 | Uhrig | ..... | 84/314 N |
| 2012/0118125 | A1 * | 5/2012 | Tanabe | ..... | 84/314 N |

FOREIGN PATENT DOCUMENTS

| | | | |
|---|---|---|---|
| JP | 56-26792 | | 3/1981 |
| JP | 56026792 | A * | 3/1981 |
| JP | 57-105680 | | 6/1982 |
| JP | 57105680 | A * | 7/1982 |
| JP | 05017690 | A * | 1/1993 |
| JP | 5-17690 | | 3/1993 |
| JP | 8-314445 | A | 11/1996 |
| JP | 08314445 | A * | 11/1996 |
| JP | 2003-504672 | A | 2/2003 |
| JP | 2005-189690 | A | 7/2005 |
| JP | 2005189690 | A * | 7/2005 |

* cited by examiner

*Primary Examiner* — David Warren
*Assistant Examiner* — Robert W Horn
(74) *Attorney, Agent, or Firm* — Arent Fox LLP

(57) ABSTRACT

Provided is a stringed instrument using frets, in which a low-pitched sound range is extended without changing the size of the main body and the sound range before the low-pitched sound range has been extended can be restored by using a capotasto. The stringed instrument comprises: a high-pitched sound string nut which is attached to an end of a fingerboard and from which a low-pitched sound string portion is removed; a low-pitched sound string nut attached at a position selected so that the string length from a saddle extends over the position of the high-pitched sound string nut; a new fingerboard provided over the area extending to the low-pitched sound string nut from the portion where the low-pitched sound string portion of the high-pitched sound string nut is removed; a minus-one fret and a zero fret newly provided on the fingerboard; and a board used for attaching a capotasto for always pushing the low-pitched sound string against the zero fret and provided on the headstock side in the vicinity of the high-pitched sound string nut.

2 Claims, 3 Drawing Sheets

STRINGED INSTRUMENT

CROSS-REFERENCE TO RELATED APPLICATION

This Application is a National Stage entry of International Application No. PCT/JP2010/004020, having an international filing date of Jun. 16, 2010; which claims priority to Japanese Application No.: 2009-144332, filed Jun. 17, 2009, the disclosure of each of which is hereby incorporated in its entirety by reference.

TECHNICAL FIELD

The present invention relates to the extension of the low-pitched sound range of a fretted stringed instrument.

BACKGROUND ART

The lowest note of a guitar and a bass, which are four-step-tuned stringed instruments, is E (E2 for a guitar and E1 for a bass).

In order to produce a sound lower than the lowest note of a guitar, the low-pitched sound range may be extended by methods such as adding one low-pitched string thereto to form a seven-string guitar or tuning the sixth string of the guitar to a lower tone.

In addition, the low-pitched sound range may be extended by a method of adopting five-step tuning for each of the string intervals to which four-step tuning has been applied.

In addition to these, there is a bass guitar which is given an extended low-pitched sound range by increasing the lengths of all the strings thereof and tuning the notes of the strings to notes that are four steps lower and which accordingly has an even larger main body.

In a case of a bass, there is a method of extending the low-pitched sound range by changing a conventional four-string bass to a five-string or a six-string bass.

Herein, the difference between a four-step-tuned stringed instrument and a five-step-tuned stringed instrument will be described.

A four-step-tuned stringed instrument is a stringed instrument which is tuned with an interval of notes that are four steps lower, by setting, from the side of a lower note string, the first string to C (do), the next string to F (fa), the next string to $B^b$ (si b), the next string to $E^b$ (mi b), and the like, and a five-step-tuned stringed instrument is a stringed instrument which is tuned with an interval of notes that are five steps lower, by setting from the side of a lower note string, the first string to C (do), the next string to G (sol), the next string to D (re), the next string to A (la), and the like.

[Patent Citation 1] JP-UM-A-5-17690

DISCLOSURE OF INVENTION

Technical Problem

Hereinafter, in order to facilitate understanding of the role of the low-pitched sound range in music, a problem that the invention is to solve will be described with the example of a guitar that is a stringed instrument in which frets are used for playing chords.

The notes to which each string of a guitar in the related art is tuned are E2 on a sixth string, A2 on a fifth string, D3 on a fourth string, G3 on a third string, B3 on a second string, and E4 on a first string.

In addition, the lowest note is the E2 on the sixth string.

In the low position (within four frets) of a fingerboard where the notes of the low-pitched sound range of the guitar are concentrated, when the root notes (which are the foundation notes or the lowest notes constituting chords) are set to a twelve-tone scale with half-note intervals from a lowest note, the three strings are set as follows: the sixth string is set to E2, F2, $F^{\#}2$, G2, and $A^b2$; the fifth string is set to A2, $B^b2$, B2, C3, and $D^b3$; and the fourth string is set to D3 and $E^b3$.

Furthermore, as the root notes, the notes of D3, and $E^b3$ of the fourth string are notes that cannot be said to be sufficiently low.

The reason is that there is a possibility that other notes constituting a chord which overlap with the foregoing notes may become high and then the notes may overlap with notes in a melody.

To examine this matter using a way of playing, when the root note on the fourth string is plucked, only one pattern of plucking the third, the second, and the first strings is adopted for playing other chord constituting notes, but when the root note on the sixth or the fifth string is plucked, two patterns of plucking the third, the second and the first strings and plucking the fourth, the third, and the second strings can be selectively adopted for playing the other notes constituting the chord.

Thus, when the root notes of the fourth string are plucked in an accompaniment, other chord constituting notes have to be sought in a narrow sound range so that the other chord constituting notes do not overlap the melody notes.

Thus, a method has been used in which the root note of the sixth string is lowered one note from E2 and tuned to D2, and this method seems to solve the problem between the melody and a chord constituting the note range, but since the notes are lowered by one step in other fret positions on the sixth string as well, there is a disadvantage in that sound of the notes of the sixth string cannot be accurately made in the chord shape (the shape taken by the fingers when pressing the strings down for a chord) that has been adopted hitherto, whereby the chord shape has to be changed.

In addition, there is a method of extending the low-pitched sound range by adding a string with a low-pitched sound, but the method is disadvantageous in that the number of strings to be pressed down for a chord increases, making the chord shape complicated, whereby the playing technique necessarily becomes more difficult than before.

For this reason, the method of five-step tuning is appropriate for playing a melody, but not appropriate for playing a chord due to its excessively wide sound range of chord constituting notes.

In the case of a bass guitar, the lengths of all the strings are extended, making the size of the main body increase, and the playing pattern thereof is changed.

The present invention is to solve the problem of the insufficient low-pitched sound range existing in the structure of such a fretted stringed instrument, and an object thereof is to provide a stringed instrument which can conveniently extend a low-pitched sound range or return to the original note range using only the existing low-pitched sound strings, without changing the tuning the low-pitched sound strings, increasing the number of low-pitched sound strings, or changing the size of the main body.

Technical Solution

In order to solve the above problem, the present invention proposes a fretted stringed instrument including a nut for the high-pitched sound strings which is mounted on the tip of the fingerboard and excludes a low-pitched sound string portion, a nut for the low-pitched sound string which is mounted at a position where the string length from the saddle is longer than the nut for the high-pitched sound strings, and a new fingerboard disposed between a portion where the low-pitched sound string portion is excluded from the nut for the high-pitched sound strings and the nut for the low-pitched sound string, wherein the stringed instrument in which a −1-fret is disposed at a predetermined position on the new fingerboard, wherein the fretted stringed instrument includes a 0-fret disposed at a position where the sound of a note of the low-pitched sound string, which is made in an open state by the nut placed at the position where the low-pitched sound string portion is excluded from the nut for the high-pitched sound strings, is made by pressing the string down on the new fingerboard, and a stand, which is for mounting a capotasto that can press the low-pitched sound string down behind the 0-fret at all times, is disposed in the head side close to the nut for the high-pitched sound strings so that the capotasto mounted on the stand does not press down the strings other than the low-pitched sound string.

Advantageous Effects

Since according to the stringed instrument of the invention, the extension of a minimally required low-pitched sound range can be realized with a playing method that has hardly ever changed, the creation of music of a new field in various forms of a guitar solo, a guitar duet, a guitar accompaniment, an electric bass guitar in a band, or the like is possible.

In addition, since the invention can be provided in a guitar main body of a size that has hardly ever changed, a case of a conventional size can be used for keeping and carrying a stringed instrument equipped with the invention, and therefore, it is possible to suppress an increase in manufacturing cost and sales cost.

BEST MODE FOR CARRYING OUT THE INVENTION

Figure 1:
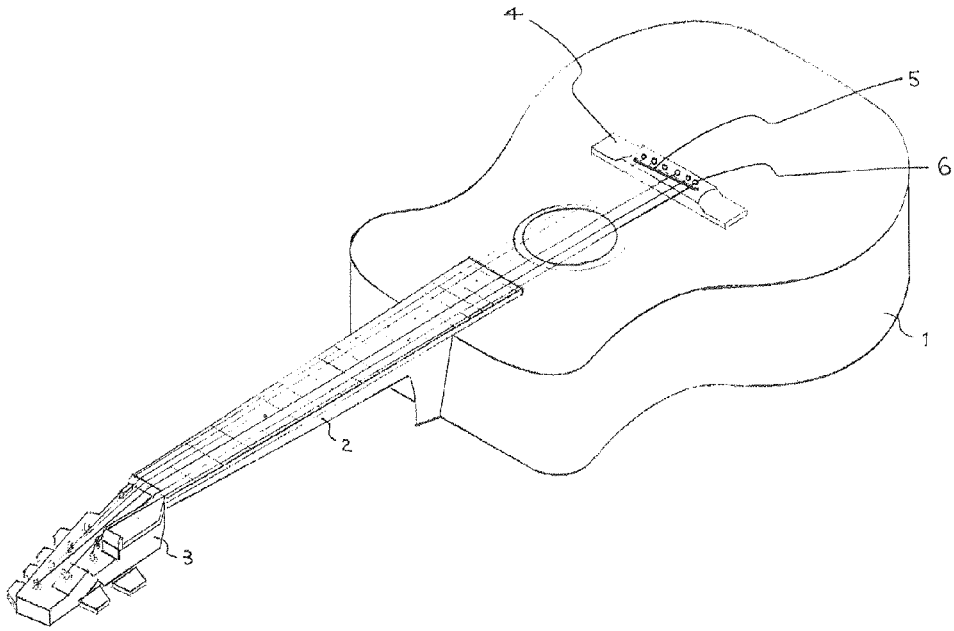
FIG. 1 is a general view of a guitar showing an embodiment of the present invention.

Hereinafter, the invention will be described in detail based on an embodiment shown in the drawings.

The guitar of FIG. 1 is broadly formed of three parts, including a body 1 for amplifying sound volume, a neck 2 having a fingerboard for controlling notes, and a head 3 provided with tuning keys and components for extending a low-pitched sound range according to the invention.

Figure 2:
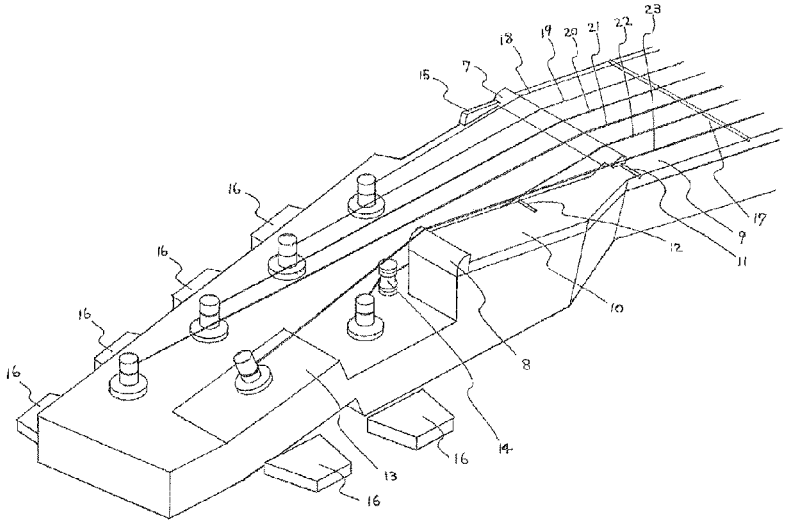
FIG. 2 is a perspective view of a head portion of a folk or an electric guitar showing an embodiment of the invention.
Figure 3:
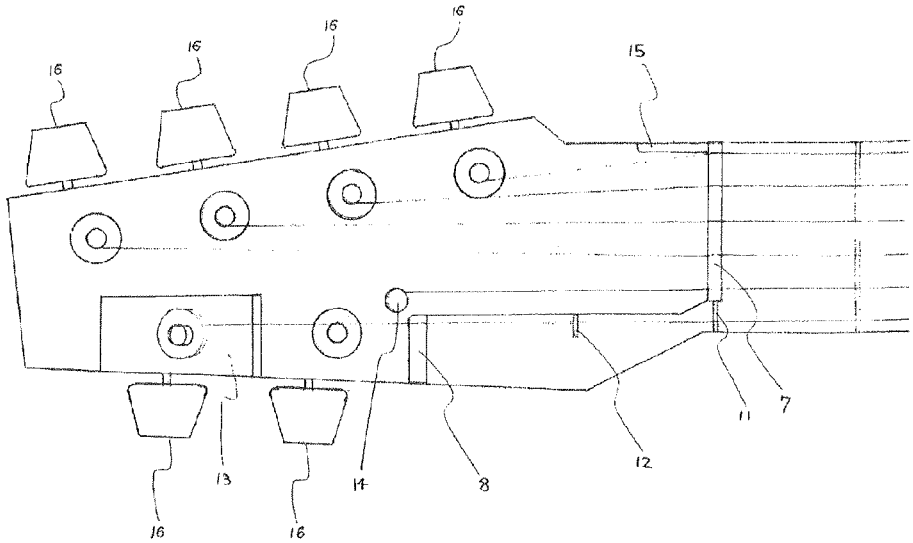
FIG. 3 is a top view of the head portion of the folk or the electric guitar showing the embodiment of the invention.
Figure 4:
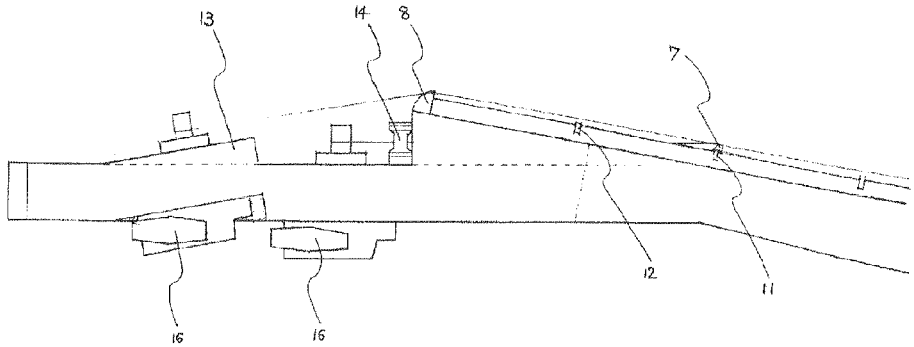
FIG. 4 is a side view of the head portion of the folk or the electric guitar showing the embodiment of the invention.

Ends of one side of the six strings are fixed to a bridge 4 of the body shown in FIG. 1 with pins 6, a first string 18 to a fifth string 22 of FIG. 2 are supported by a nut a7 of FIG. 2 via a saddle 5 of FIG. 1, a sixth string 23 of FIG. 2 is supported by a nut b8 of FIG. 2 via the saddle 5 of FIG. 1, and each of the strings is wound by tuning keys 16 which are provided so as to be four in number (for the fourth, third, second, and first strings) on the right side and two in number (for the fifth and sixth strings) on the left side of the head 3 of FIG. 1.

In FIG. 2, the sixth string 23 of a nut in the related art is excluded from the nut a7, which supports the first string 18 to the fifth string 22, and tuning is performed for notes of E4 for the first string 18, B3 for the second string 19, G3 for the third string 20, 33 for the fourth string 21, and A2 for the fifth string 22 (as in the related art).

The nut b8 is a nut provided at a position on the head for lengthening a string length by one note so that the original lowest note E2 of the sixth string 23 is lowered by one step to a note D2, and is provided at the tip of a fingerboard b10 which is extended in the same horizontal direction as a fingerboard a9.

When a string length (which is a string length of the related art) from the saddle 5 of FIG. 1 to the nut a7 is 650.00 mm, the position is located at a spot about 729.60 mm away from the saddle 5 of FIG. 1.

$$T2 = M \times (12^{th} \text{ root of } 2) \times (12^{th} \text{ root of } 2)$$
$$\approx M \times 1.0594631 \times 1.0594631$$
$$\approx M \times 1.122462$$

650.00 mm×1.122462≈729.60 mm (logical value)

T2: A string length from the saddle 5 of FIG. 1 to the nut b8

M: A string length from the saddle 5 of FIG. 1 to the nut a7 for high-pitched sound strings=a string length of the related art 12th root of 2: Musical temperament obtained by dividing an octave into average 12 semi-tones (12-tone equal temperament)

In addition, the fretted stringed instrument is provided with a 0-fret 11 and a −1-fret 12 on the fingerboard b10.

In a case of a guitar having a string length (which is a string length of the related art) from the saddle 5 of FIG. 1 to the nut a7 of 650.00 mm, the position of the −1-fret 12 is located at a spot about 688.65 mm away from the saddle 5 of FIG. 1.

$$T1 = M \times (12^{th} \text{ root of } 2)$$
$$\approx M \times 1.0594631$$

650.00 mm×1.0594631≈688.65 mm (logical value)

T1: A string length from the saddle 5 of FIG. 1 to the position of the −1-fret 12

Herein, the reason that the position of the 0-fret 11 is not placed on the contact face of the nut a7 and the fingerboard a9 will be described.

By applying tension to a string on a fret used to make a sound by pressing down the string with a finger, a note becomes slightly high at the position of the logical value.

For this reason, the position of the 0-fret 11 which does not make a sound if a string is not pressed down is located slightly further toward the direction of the nut b8 than the position of the nut a7 which makes a sound without pressing a string down.

If a coefficient of tension by pressing a string down is set to 1.005, a string length from the saddle 5 to the 0-fret 11 is 653.25 mm.

650.00 mm×1.005=653.25 mm

In the same manner, the position of the −1-fret 12 for pressing a string down is located slightly further toward the direction of the nut b8 than the logical value.

If a coefficient of tension by pressing a string down is set to 1.005, a string length from the saddle 5 to the −1-fret 12 is 692.09 mm.

688.65 mm×1.005≈692.09 mm

In addition, in regard to the positions, since tension is differently applied according to the thickness of a string, the string length of each string is finely adjusted by cutting the saddle, or the like.

However, in regard to the position of the 0-fret, Document 1 does not make a distinction between a nut and a fret, and also recognizes the nut as a fret in which only the height changes, and thus, the position of the 0-fret 11 shown in the drawings of the invention is located on the contact face of the nut a7 and the fingerboard a9.

However, the fret is a component which makes a sound when a string is pressed down with a finger and new tension is applied thereto, and is to be distinguished, in terms of the different functions thereof, from the nut, which is a component providing support from the first stage and for making sound without having tension applied thereto.

Therefore, at the position of the 0-fret of Document 1, a note is made too high due to the function of the fret, whereby an accurate note cannot be made.

An oblique stand 13 for installing a tuning key 16 of the sixth string 23 of FIG. 2 is provided perpendicularly to the shaft of the tuning key 16 so as to wind the sixth string 23.

A pulley 14 of FIG. 2 is to guide the fifth string 22 to a tuning key while avoiding the saddle of the fingerboard b10 acting as an obstacle, which otherwise would not be directly wound on the shaft of the tuning key 16.

A capotasto mounting stand 15 of FIG. 2 is a stand for setting an open note of the sixth string 23 to E2 as in a guitar of the related art, and is a stand for mounting a capotasto in order to pluck only the sixth string 23 on the 0-fret 11 at all times.

Figure 5:
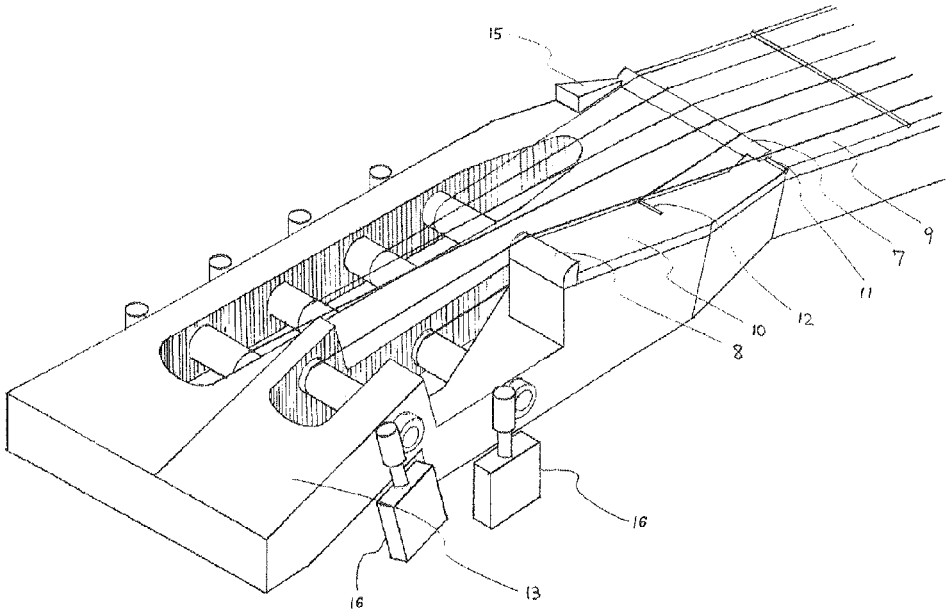
FIG. 5 is a perspective view of a head portion of a classical guitar according to an embodiment of the invention.

FIG. 5 is a perspective view of a head portion of a classical guitar provided with the components of the invention.

The lowest note is D2 which is one step lower than the conventional note.

Figure 6:
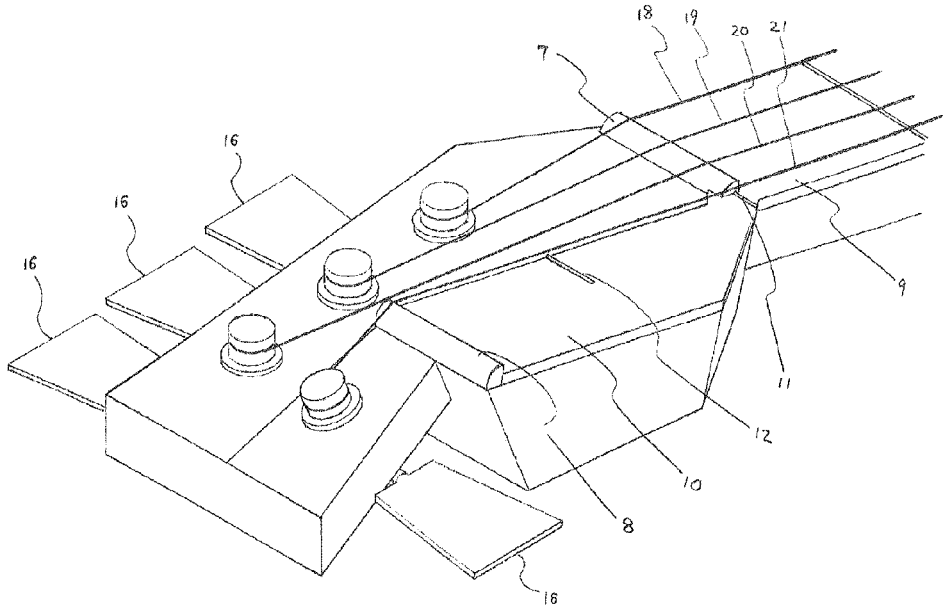
FIG. 6 is perspective view of a head portion of an electric bass guitar according to an embodiment of the invention.

FIG. 6 is a perspective view of a head portion of an electric bass provided with the components of the invention.

The lowest note is D1 which is one step lower than the conventional note.

The tuning of the electric bass in the related art is E1 for the fourth string 21, A1 for the third string 20, D2 for the second string 19, and G2 for the first string 18.

Embodiment

Hereinafter, the characteristic of the guitar according to the invention will be described with an actual playing example.

It is assumed that there is a chord progression in which root notes including |C|GonB|Am|EmonG|F|Em|Dm7|G7| gradually go down.

When the root notes are accompanied at a low position using a guitar of the related art, the fifth string 22 is plucked for the portion of |C|GonB|Am|, the sixth string 23 is plucked for the portion of |EmonG|F|Em|, and thus the root notes can be played gradually going down up to this point, but the fourth string 21, which is one octave higher, has to be plucked for the portion of |Dm7|, and accordingly, the natural flow of the root notes up to that time is broken up.

However, when the root notes are accompanied at a low position using the guitar of the invention, since the fifth string 22 is plucked for the portion of |C|GonB|Am|, and only the sixth string 23 is plucked for the portion from |EmonG|F|Em| to |Dm7|, root notes can be played with a natural flow gradually going down.

In addition, another chord progression will be shown.

It is assumed that there is a five-step chord progression of |Am7|D7|B7onD#|Em|Am7|Am7onD|G|.

When root notes accompanied at the low position using the guitar of the related art are examined, the fifth string 22 is plucked for |Am7|, the fourth string 21 is plucked for |D7|B7onD#|Em|, the fifth string 22 is plucked for |Am7|, the fourth string 21 is plucked for |Am7onD|, and the sixth string 23 is plucked for |G|.

In the same manner, when root notes accompanied at the low position using the guitar of the invention are examined, it is possible to play the root notes in the same way as the guitar of the related art, but on the other hand, it is possible to play the root notes at a low position such that the fifth string 22 is plucked for |Am7|, the sixth string 23 is plucked for |D7|B7onD#|Em|, the fifth string 22 is plucked for |Am7|, and the sixth string 23 is plucked for |Am7onD|G|, and therefore, a pattern of playing the root notes with a sense of greater stability can also be used.

When music is performed at the same low-pitched sound range as that played by a guitar not equipped with the invention, the performance can be easily achieved by pressing the strings down with a capotasto behind the 0-fret 11 at all times, using the capotasto mounting stand 15.

| Description of Reference Numerals |
|---|
| 1: body |
| 2: neck |
| 3: head |
| 4: bridge |
| 5: saddle |
| 6: pin |
| 7: nut a |
| 8: nut b |
| 9: fingerboard a |
| 10: fingerboard b |
| 11: 0-fret |
| 12: −1-fret |
| 13: sixth string tuning key installation oblique stand |
| 14: fifth string guiding pulley |
| 15: capotasto mounting stand |
| 16: tuning key |
| 17: 1st fret |
| 18: first string |
| 19: second string |
| 20: third string |
| 21: fourth string |
| 22: fifth string |
| 23: sixth string |

The invention claimed is:

1. A fretted stringed instrument comprising: a nut for high-pitched sound strings which is mounted on a tip of a fingerboard and excludes a low-pitched sound string;

a nut for the low-pitched sound string which is mounted at a position where a string length from a saddle is longer than the nut for the high-pitched sound strings; and a new fingerboard disposed between a portion where the low-pitched sound string portion is excluded from the nut for the high-pitched sound strings and the nut for the low-pitched sound string, where a −1-fret is disposed at a predetermined position on the new fingerboard.

2. A fretted stringed instrument comprising:

a nut for high-pitched sound strings which is mounted on a tip of a fingerboard and excludes a low-pitched sound string;

a nut for the low-pitched sound string which is mounted at a position where a string length from a saddle is longer than the nut for the high-pitched sound strings; and a new fingerboard disposed between a portion where the low-pitched sound string portion is excluded from the nut for the high-pitched sound strings and the nut for the low-pitched sound string, where a −1-fret is disposed at a predetermined position on the new fingerboard, wherein the fretted stringed instrument includes a 0-fret disposed at a position where the sound of a note of the low-pitched sound string, which is made in an open state by the nut placed at the position where the low-pitched sound string portion is excluded from the nut for the high-pitched sound strings, is made by pressing the string down on the new fingerboard, and a stand, which is for mounting a capotasto that can press the low-pitched sound string down behind the 0-fret at all times, is disposed in the head side close to the nut for the high-pitched sound strings so that the capotasto mounted on the stand does not press down the strings other than the low-pitched sound string.

* * * * *